US006612718B1

(12) United States Patent
Packer et al.

(10) Patent No.: US 6,612,718 B1
(45) Date of Patent: Sep. 2, 2003

(54) OPTICAL FLANGE FOR MAINTAINING LUMINAIRE PERFORMANCE AND SMOOTHLY COUPLING A LENS TO A REFLECTOR FOR ENCLOSED LUMINAIRES

(75) Inventors: Michael Packer, Licking, OH (US); John T. Marron, III, Licking, OH (US); James M. Pacocha, Franklin, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 10/087,571

(22) Filed: Mar. 1, 2002

(51) Int. Cl.[7] ..... F21V 29/00
(52) U.S. Cl. ..... 362/267; 362/328
(58) Field of Search ..... 362/374, 375, 362/267, 310, 311, 328

(56) References Cited

U.S. PATENT DOCUMENTS 5,477,441 A * 12/1995 Budnovitch et al. ..... 362/362
5,913,447 A * 6/1999 Carpenter ..... 220/664

* cited by examiner

*Primary Examiner*—Stephen Husar
*Assistant Examiner*—Guiyoung Lee
(74) *Attorney, Agent, or Firm*—Kenneth E. Darnell

(57) ABSTRACT

An optical interface for coupling a refractor and a reflector in a luminaire assembly includes a flange having an inner surface and an outer surface, the outer surface having reflecting means and disposed adjacent an air gap, the flange having a shape which works in concert with the reflector and is adapted to be affixable to the reflector and the refractor.

35 Claims, 5 Drawing Sheets

Fig. 1
(PRIOR ART)
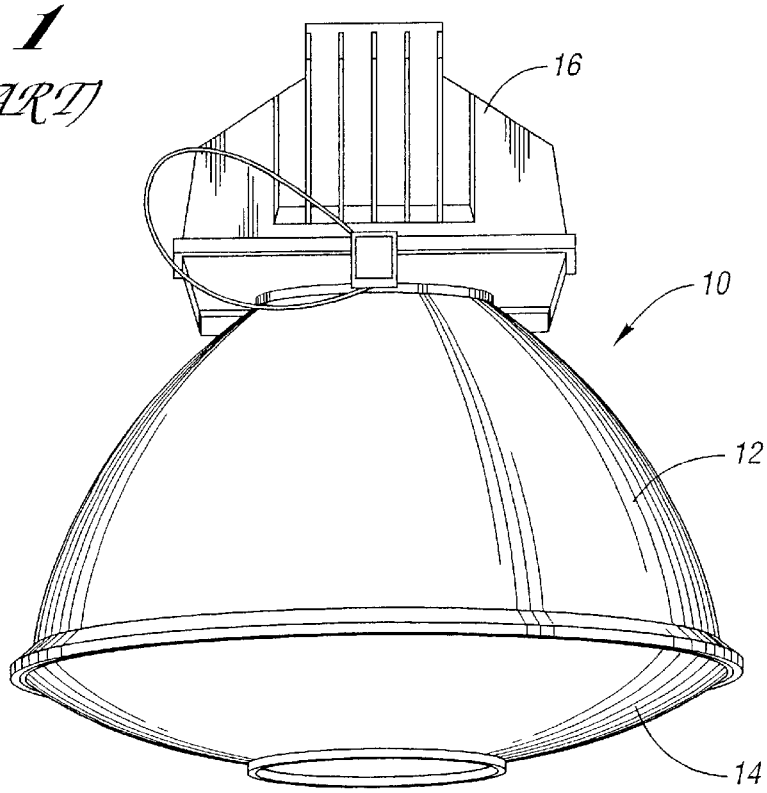
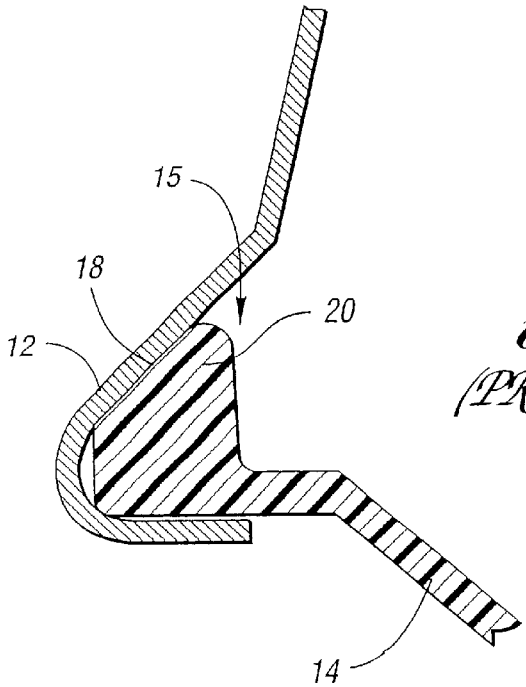
Fig. 2
(PRIOR ART)

Fig. 8
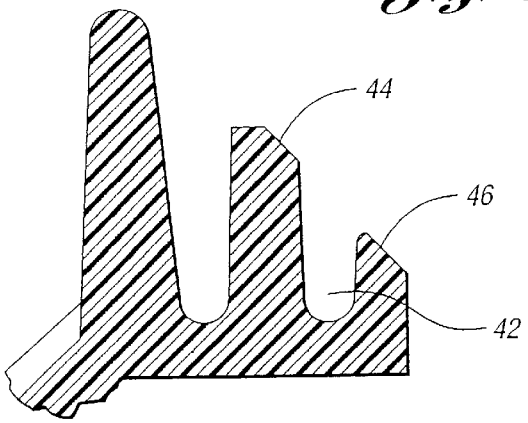
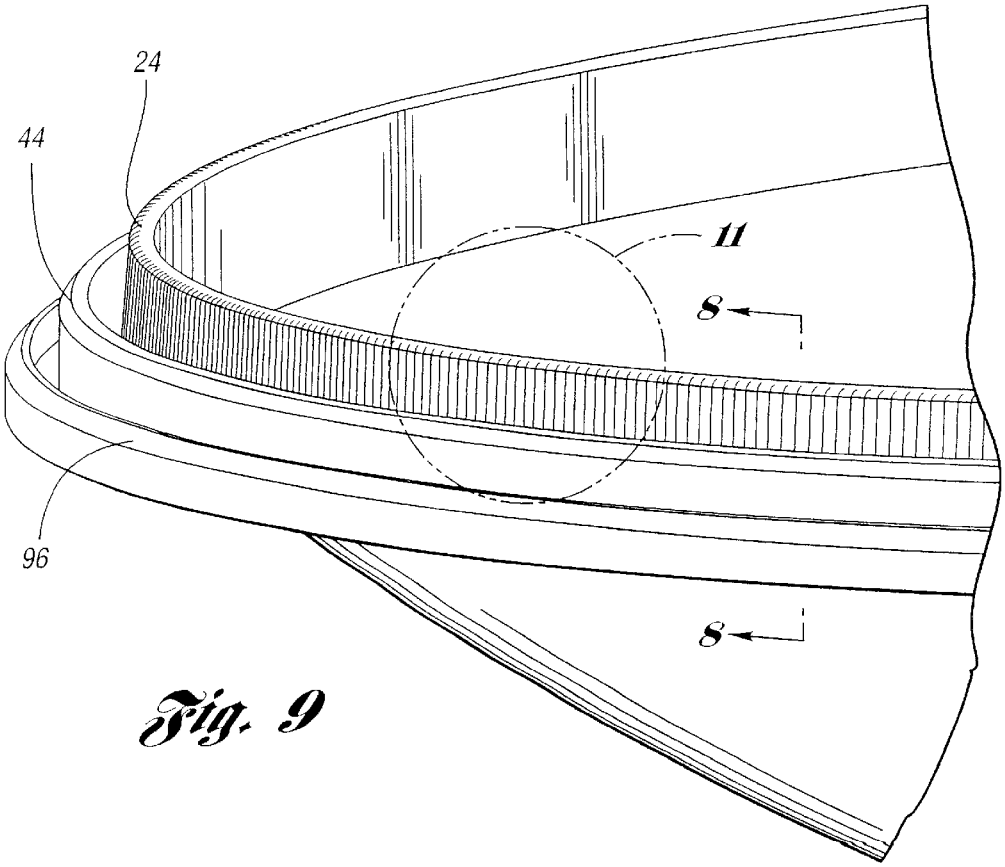
Fig. 9

OPTICAL FLANGE FOR MAINTAINING LUMINAIRE PERFORMANCE AND SMOOTHLY COUPLING A LENS TO A REFLECTOR FOR ENCLOSED LUMINAIRES

TECHNICAL FIELD

The present invention relates to an optical interface for coupling a refractor and a reflector in a luminaire assembly.

BACKGROUND ART

Enclosed luminaires, i.e. luminaires having a sealed housing and optical unit, are used in lighting applications which for performance, safety, or other reasons, including ease of cleanability, require a sealed fixture. Outdoor luminaires, for example, are often hermetically enclosed to protect and insulate the luminaire components from the effects of sunlight and inclement weather. Lighting systems in the food industry similarly require an effectively sealed luminaire so that the system can be hosed down under high pressure and cleaned easily without damaging the internal luminaire components. Additionally, the external surfaces of food luminaires must be free of crevasses and horizontal surfaces where particulates such as food and dirt can accumulate and become difficult to remove.

The above-mentioned enclosed luminaires often employ a reflector coupled with a refracting lense to segregate the light source, optical elements and electro-mechanical components from the surrounding environment and environmental conditions. In these systems, however, the optical performance of the refractor/reflector combination is often degraded because of a poor interface. For example, light impinging on the interface is often absorbed or misdirected due to the shape and types of materials at the interface. The presence of flanges, gaskets or the need to keep the external portion of the luminaire smooth at the interface contribute to degraded optical performance. Moreover, if the refractor is part of a door system that meets the reflector to enclose the luminaire, then optical performance is also often degraded by the design criteria of the door itself. In each of the foregoing situations, the interface is, at best, optically benign. More accurately, the interface is optically subtractive.

Consequently, a need exists for an optical interface for use in an enclosed luminaire which mitigates the light loss which typically results from coupling a refractor with a reflector. Such an optical interface should allow a refractor and a reflector to interface smoothly both optically and mechanically.

DISCLOSURE OF INVENTION

It is a principle object of the present invention to provide an interface for use in a luminaire assembly such as an enclosed luminaire which allows a refractor component and a reflector component to interface both optically and mechanically without degrading the luminaire performance.

In carrying out the above object, there is provided an optical interface for coupling a refractor and a reflector in a luminaire assembly. The interface includes a flange having an inner surface and an outer surface. In keeping with the invention, the outer surface includes reflecting means such as, for example, a plurality of reflecting prisms or a metalized coating. The optical flange is disposed adjacent a gaseous gap such as, for example, an air gap, and comprises a shape suitable to work in concert with the reflector as an extension therof. The optical flange is adapted to be affixable to the reflector and the refractor.

These and other objects, features and advantages of the present invention will be more readily apparent with reference to the following diagrams wherein like reference numerals correspond to like components.

BRIEF DESCRIPTION OF DRAWINGS

FIG. 1 is a schematic diagram of a prior art enclosed luminarie;

FIG. 2 is an enlarged cross sectional diagram of the luminiare of FIG. 1;

FIG. 8 is an enlarged cross sectional diagram of a fourth alternative embodiment of the optical interface of the present invention;

FIG. 9 is a perspective view of the optical interface of FIG. 8;

BEST MODE FOR CARRYING OUT THE INVENTION

Figure 3:
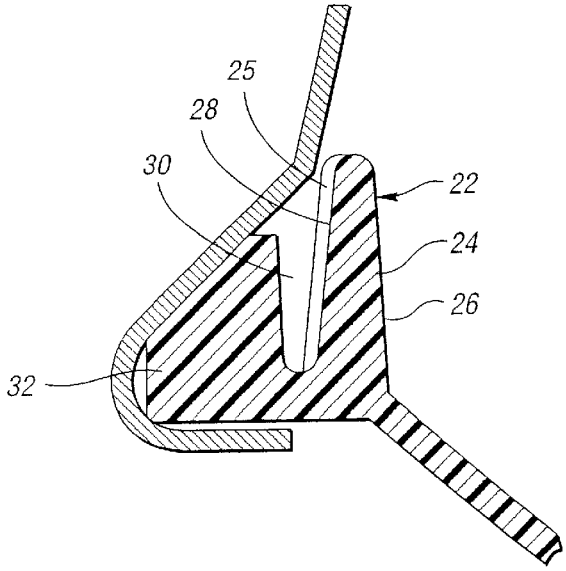
FIG. 3 is an enlarged cross sectional diagram of the improved optical interface of the present invention.

With reference to FIGS. 1 and 2 of the drawings there is shown a prior art enclosed luminaire referred to generally by reference numeral 10. Luminiare 10 includes a spun aluminum housing 12 and a refracting lense 14 affixable thereto. Luminiare 10 includes a ballast and electrical component chamber 16 and a light source such as an HID bulb (not shown). Luminaire 10 is an enclosed High Intensity Discharge (HID) luminaire sold by the Holophane Division of National Service Industries, Inc. under the tradename Endur-alume V®.

Luminiare 10, as is typical of prior art systems, includes a refractor/reflector interface 18 which may absorb or misdirect certain light and thus degrade the optical performance of the fixture. More specifically, as shown in FIG. 2, the direct interface 18 between the aluminum housing 12 (which functions as a reflector) and the ledge 20 of refracting lense 14 creates a light loss area 15 which, depending on the shapes of the involved components and the type and placement of the light source, could meet or exceed 2–10 percent of the total light emitted from the luminaire. In design applications where smooth and non-horizontal external surfaces are desired, such as, for example in the case of food luminaires, ledge 20 must contact an even larger surface area resulting in even greater light loss and, accordingly, greater luminaire inefficiency.

Figure 4:
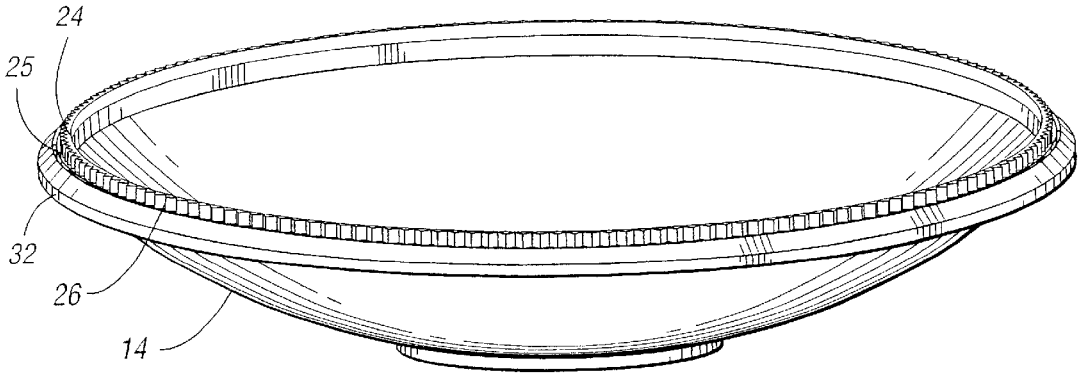
FIG. 4 is a perspective view of the optical interface of FIG. 4.
Figure 5:
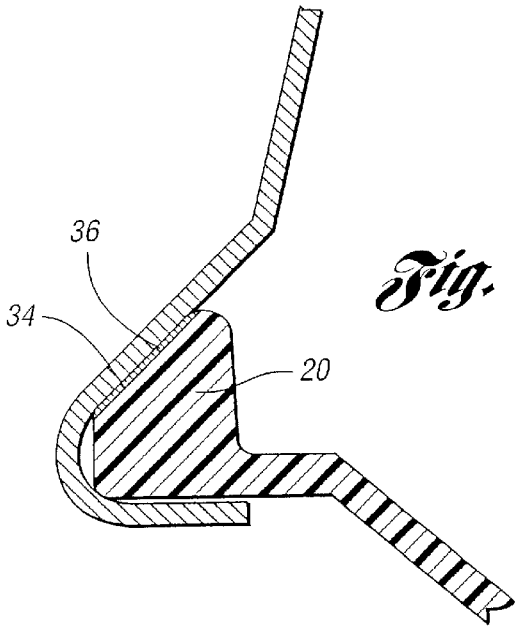
FIG. 5 is an enlarged cross sectional diagram of a first alternative embodiment of the optical interface of the present invention.

To overcome the aforementioned disadvantages of prior art systems, applicants have developed and disclose herein an improved optical interface which functions as an extension of the reflector element itself and thus masks the light loss attendant in such systems. As shown in FIGS. 3–5 of the drawings, the improved optical interface is designated generally by reference numeral 22 and comprises a flange 24 having a shape suitable to work in concert with the reflector 12 as an extension thereof. In the embodiment shown, flange 24 is, therefore, conically shaped and substantially vertically oriented. However, it is understood that any suitable shape and orientation may be used depending on the nature, type, shape, and orientation of the involved components, particularly the reflector 12. Flange 24 is adapted to be affixable to both the reflector 12 (here fixture housing 12) and refractor 14 (here a refracting lense). In keeping with the invention, flange 24 may also comprise any suitable medium and preferably, but not necessarily, a substantially transparent medium such as, for example, acrylic, polycarbonate, polyeurethane, glass, etc. Again, however, any suitable material may be used depending on the application as well as the nature, type, shape and orientation of the involved components.

In keeping with the invention, flange 24 includes an inner surface 26 and an outer surface 28 disposed adjacent to a gaseous gap 30 such as, for example, an air gap. Gap 30 creates a boundary layer which, because of a density difference in medium, allows light to reflect through Total Internal Reflection. Flange 24 may further include suitable reflecting means such as, for example, one or more reflecting prisms disposed on one or both of flange outer surfaces 26 and 28 as discussed in further detail below. As seen, optical interface 22 may further include a mounting flange or ring 32 which directly abuts and is affixable to reflector 12 and refractor 14. Like flange 20, mounting ring 32 may similarly comprise any suitable medium including the above-mentioned acrylic, polycarbonate, polyeurethane, glass, etc.

In a preferred embodiment, flange 24 is substantially vertically oriented and includes one or more and preferably a plurality of vertical reflecting prisms such as ninety (90) degree reflecting prisms 25 disposed on outer surface 26. Of course, any shape flange 24 and any suitable reflecting means and prismatic structure and orientation may be used depending on the application and the desired effect on optical performance. Thus, the reflecting means may comprise, without limitation, circumferential prisms, horizontal prisms, vertical prisms, metalized prisms or sections, painted prisms or sections, an insertable metal or metalized ring (not shown) or any suitable combination thereof disposed on or about the flange inner and/or outer surfaces 26 and 28, respectively.

Figure 7:
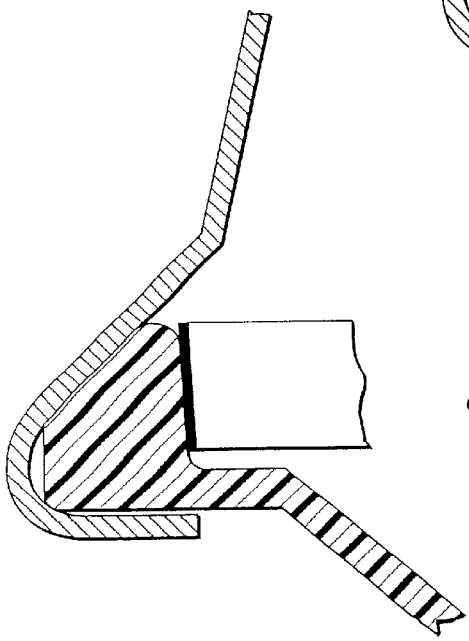
FIG. 7 is an enlarged cross sectional diagram of a third alternative embodiment of the optical interface of the present invention.
Figure 10:
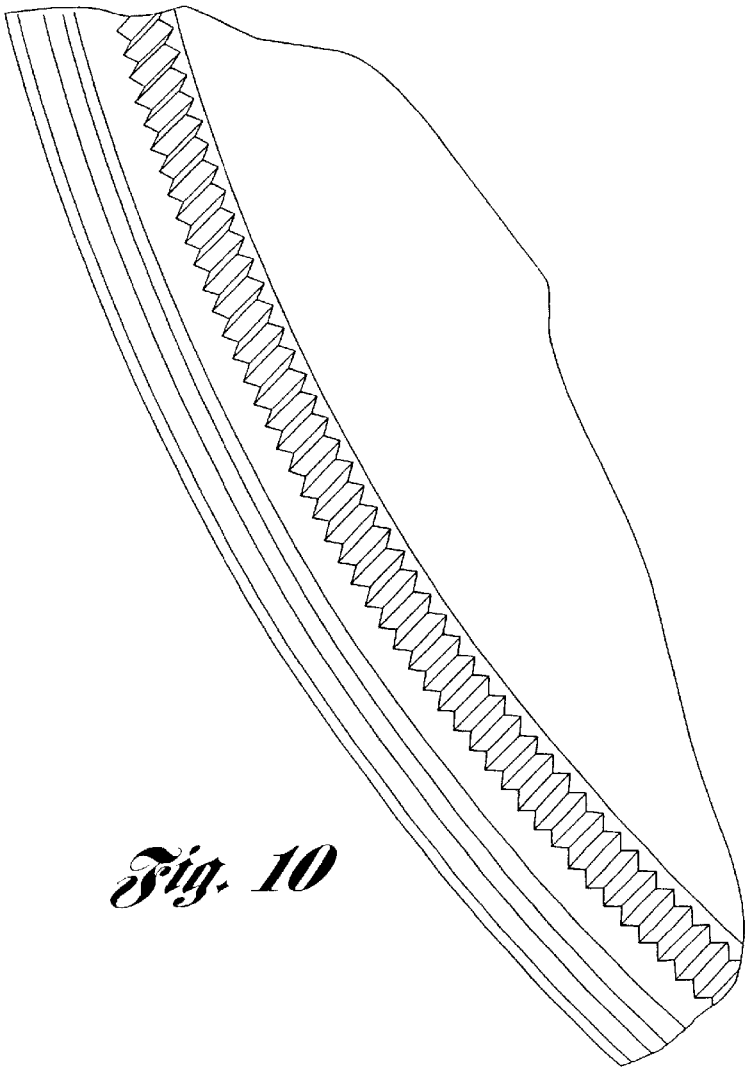
FIG. 10 is an enlarged perspective view of the optical interface of FIG. 9 in the area designated by numeral 11; and, FIG. 11 is an enlarged cross sectional view of the optical interface of FIG. 9 along line 8—8.
Figure 11:
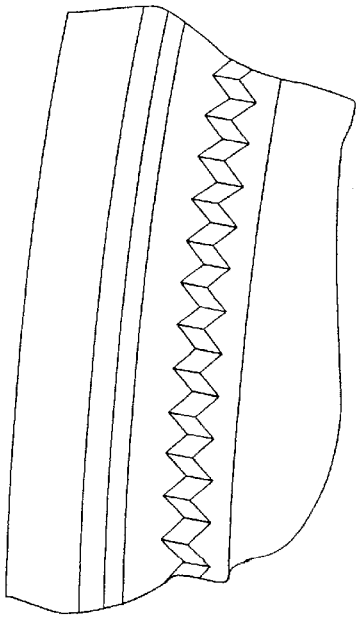

In keeping with the invention, flange 24 may be made a part of and contiguous with refractor 14. Thus, flange 24 may be injection molded as part of the refractor lense 14 itself. Optical flange 24 may also be manufactured and supplied as a separate component as shown, for example, in FIG. 7. Still further, flange 24 may be configured to work as an optical glass flange.

Figure 6:
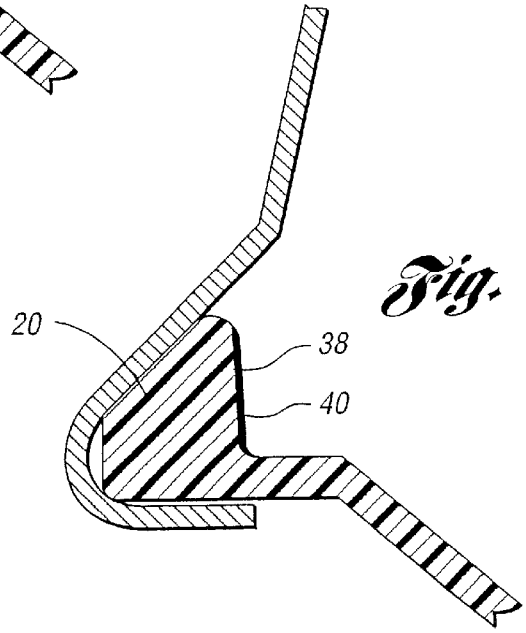
FIG. 6 is an enlarged cross sectional diagram of a second alternative embodiment of the optical interface of the present invention.

In alternative embodiments as shown in FIGS. 5–6 of the drawings, the advantages of the above described flange 24 may also be achieved in part by providing a suitable reflecting/refracting means on one or more surfaces of a prior art mounting flange 20. For example, outer surface 34 may, be coated with a metal layer 36 such as for example, silver i.e. "metalized" as shown in FIG. 5. Similarly inner surface 38 may be coated with a metallic layer 40. A metal ring or suitable metalized material may also be disposed adjacent surfaces 34 and/or 38 to achieve the same function. In such case, the need for a gap 30 and, of course, a flange 24 is obviated.

In a further alternative embodiment, shown in FIGS. 8–11, mounting flange 32 may be separated by an additional air gap 42 to enhance the cooling capability of the flange. Gap 42 thus defines 2 sub flanges 44 and 46 wherein sub flange 46 abuts to the inner surface of housing 12. As in the embodiments above, the inner and/or outer surfaces 26 and 28 of flange 28 may include suitable reflecting means of the type described above. See, for example, FIGS. 10 and 11. In this embodiment, flange 28 may, of course, also be integrally molded as a contiguous part of refractor 14 or as a separate component.

Regardless of the specific embodiment, the function of the optical flange is the same. That is, it captures light that would otherwise be absorbed or misdirected and redirects the same in a specified direction.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An optical interface for coupling a refractor and a reflector in a luminaire assembly, comprising:

a flange having an inner surface and an outer surface, the outer surface having reflecting means and disposed adjacent an air gap, the flange having a shape which works in concert with the reflector and is adapted to be affixable to the reflector and the refractor.

2. An optical interface as in claim 1, wherein the reflecting means comprises a plurality of reflecting prisms.

3. An optical interface as in claim 2, wherein the reflecting prisms are vertical reflecting prisms.

4. An optical interface as in claim 1, wherein the reflecting means comprises a metalized coating.

5. An optical interface for coupling a refractor and a reflector in a sealed luminiare assembly, the interface comprising:

a susbstantially vertical flange having an inner surface and an outer surface having a plurality of reflecting prisms disposed thereon, the flange disposed adjacent an air gap and adapted to be affixable to the reflector and the refractor, wherein the air-spaced prismatic flange functions to capture light that would otherwise be absorbed or misdirected and redirect the light in a specified direction by total internal reflection.

6. An optical interface as in claim 5, wherein the reflecting prisms are vertical reflecting prisms.

7. A refractor for use in a luminaire assembly, comprising:

a mounting ring; and a flange having an inner surface and an outer surface, the outer surface having reflecting means and disposed adjacent an air gap, the flange having a shape which works in concert with a reflector and is adapted to be affixable to the reflector and the mounting ring.

8. A refractor for use in a luminaire assembly, comprising:

a mounting ring; and a substantially vertical flange having an inner surface and an outer surface having a plurality of reflecting prisms disposed thereon, the flange disposed adjacent an air gap and adapted to be affixable to a reflector and the mounting ring, wherein the air-spaced prismatic flange functions to capture light that would otherwise be absorbed or misdirected and redirect the light in a specified direction.

9. An optical interface for coupling a refractor and a reflector in a luminaire assembly, the interface comprising:

a flange having an inner surface and an outer surface, the outer surface having a reflective metallic layer disposed thereon, the flange having a shape which works in concert with the reflector and is adapted to be affixable to the reflector and the refractor.

10. A refractor for use in a luminaire assembly, comprising:

a mounting ring; and a flange having an inner surface and an outer surface, the outer surface having a metallic layer disposed thereon, the flange having a shape which works in concert with a reflector and is adapted to be affixable to the reflector and the mounting ring.

11. An optical interface for coupling a refractor and a reflector in a luminaire assembly, comprising:

a flange having an inner surface with reflecting means disposed thereon, and an outer surface, the flange having a shape which works in concert with the reflector and is adapted to be affixable to the reflector and the refractor.

12. An optical interface as in claim 11, wherein the reflecting means comprises a plurality of reflecting prisms.

13. An optical interface as in claim 12, wherein the reflecting prisms are vertical reflecting prisms.

14. An optical interface as in claim 11, wherein the reflecting means comprises a metalized coating.

15. An optical interface for coupling a refractor and a reflector in a luminaire assembly, comprising:

a reflecting flange having a shape which works in concert with the reflector; and a mounting flange affixable to the reflecting flange to define an air gap therebetween, the reflecting flange and the mounting flange adapted to be afffixable to the reflector and the refractor.

16. An optical interface as in claim 15, wherein the reflecting flange has an inner surface and an outer surface, at least one of which includes reflecting means.

17. An optical interface as in claim 16, wherein the reflecting means comprises a plurality of reflecting prisms.

18. An optical interface as in claim 17, wherein the reflecting prisms are vertical reflecting prisms.

19. An optical interface as in claim 15, wherein the reflecting means comprises a metalized coating.

20. In a luminaire assembly having a reflector and a refractor coupled together about opposing edge surfaces to enclose at least portions of an optical chamber in the vicinity of a juncture between the reflector and the refractor, the improvement comprising interface means disposed at the juncture between the reflector and the refractor for facilitating coupling of said reflector and refractor together and for directing light incident on said juncture in desired directions, the interface means comprising at least one flange having respective inner and outer surfaces and a distal end disposed in proximity to the reflector, the flange extending from the refractor, the interface means further comprising a body ring disposed outwardly of the flange and spaced therefrom by the agency of an air gap located therebetween, and means disposed on at least portions of the surfaces of the flange for redirecting at least portions of the light incident thereon in directions outwardly of the luminaire assembly.

21. In the luminaire assembly of claim 20 wherein the redirecting means comprise a plurality of prisms.

22. In the luminaire assembly of claim 20 wherein the flange is conically shaped in section.

23. In the luminaire assembly of claim 20 wherein the redirecting means comprise a metallized coating.

24. In the luminaire assembly of claim 20 wherein the flange and the body ring are integrally formed with the refractor.

25. In the luminaire assembly of claim 20 wherein the redirecting means are disposed on at least portions of the outer surfaces of the flange.

26. In the luminaire assembly of claim 25 wherein the redirecting means comprise a metallized layer.

27. In the luminaire assembly of claim 20 wherein the interface means comprise a single flange.

28. In the luminaire assembly of claim 20 wherein the interface means comprise at least three flanges, the flanges being spaced apart, spaces between successive flanges comprising air gaps.

29. In the luminaire assembly of claim 28 wherein each of the flanges have outer and inner surfaces, at least certain of the surfaces of said flanges having portions of the redirecting means disposed thereon.

30. In the luminaire assembly of claim 20 wherein the interface means further comprises means carried by the reflector for connecting the reflector to the refractor.

31. In a luminaire assembly having a reflector and a refractor coupled together about opposing edge surfaces to enclose at least portions of an optical chamber in the vicinity of a juncture between the reflector and the refractor, the improvement comprising interface means disposed at the juncture between the reflector and the refractor for facilitating coupling of said reflector and refractor together and for directing light incident on said juncture in desired directions, the interface means comprising a body ring disposed at the juncture between the reflector and the refractor and having inner and outer surfaces, the interface means further comprising means disposed on at least portions of the surface of the body ring for redirecting at least portions of the light incident thereon in directions outwardly of the luminaire assembly.

32. In the luminaire assembly of claim 31 wherein the redirecting means are disposed on at least portions of the outer surfaces of the body ring.

33. In the luminaire assembly of claim 31 wherein the redirecting means are disposed on at least portions of the inner surfaces of the body ring.

34. In the luminaire assembly of claim 31 wherein the body ring is formed integrally with the refractor.

35. In the luminaire assembly of claim 31 wherein the interface means further comprise means carried by the reflector for connecting the reflector to the refractor.

* * * * *